United States Patent [19]

Mamvriisky et al.

[11] 4,027,860

[45] June 7, 1977

[54] METHOD OF CONTROLLING THE DENSITY OF A PLUGGING FLUID

[76] Inventors: Alexandr Sergeevich Mamvriisky, prospekt Revoljutsii, 26/36, kv.7; Alexandr Mikhailovich Lapchenko, ulitsa Moskovskaya, 68, both of Grozny, U.S.S.R.

[22] Filed: July 24, 1975

[21] Appl. No.: 598,550

[52] U.S. Cl. ..... 259/149; 259/151; 259/168; 239/433

[51] Int. Cl.[2] ..... B28C 7/04

[58] Field of Search ..... 259/149, 148, 147, 146, 259/150, 4A, 151, 161, 168, 4 R; 239/433, 434; 302/14; 222/145

[56] References Cited

UNITED STATES PATENTS

| | | | |
|---|---|---|---|
| 1,649,062 | 11/1927 | Halliburton | 259/151 |
| 3,425,669 | 2/1969 | Gaddis | 259/18 |

*Primary Examiner*—Richard E. Aegerter
*Assistant Examiner*—Willis Little
*Attorney, Agent, or Firm*—Lackenbach, Lilling & Siegel

[57] ABSTRACT

A method of controlling the density of a plugging fluid including shaping the jet of the carrier liquid into a flat jet and rotating this jet about the longitudinal axis thereof in the area of mixing thereof with a dry cementation material. The angle at which the flat jet intersects in the transverse direction the body of the dry material defines the effective material-engaging area and the density of the fluid obtained.

6 Claims, 7 Drawing Figures

METHOD OF CONTROLLING THE DENSITY OF A PLUGGING FLUID

The present invention relates to the technique of cementing oil and gas wells and, more particularly, it relates to the processes employed for preparation of plugging fluids.

Cementing of oil and gas wells is among the most important operations in construction of such wells, and the quality of cementing deep wells depends to a great extent upon the quality of the plugging fluid pumped into the well. Of paramount is the problem of maintaining the predetermined density of the fluid throughout the entire plugging operation, for even slight deviations from the predetermined density might cause a serious breakdown.

There is known a stepwise method of controlling the density of a plugging fluid by varying the flow rate of the carrier liquid by aid of positioning a nozzle of a required by rotation of a magazine, by replacing a connection member, or else by varying the pressure of the liquid being pumped (see, for example, "Apparatus and Processes of Well Cementation" by S.V. Logvinenko, NEDRA Publishers, Moscow, 1968).

Preparation of a plugging fluid by this known method and controlling the density of this fluid are performed in the following sequence:

- feeding a dry cementing mixture through a funnel into a mixing chamber;
- pumping a carrier liquid through a replaceable nozzle into the mixing chamber;
- mixing the dry cementing mixture with the carrier liquid;
- directing the prepared fluid into the discharge conduit.

Among the disadvantages of this known method are:

- impossibility of steplessly controlling the density of the prepared fluid in the course of the plugging process;
- a considerable waste of the fluid directed to waste as not conforming to the density requirements at the initial stage of the plugging operation;
- the prolonged period of coming up to the duty of preparation of the plugging fluid of the required density.

There is known another method of controlling the density of a plugging fluid, wherein the density of the already prepared plugging fluid is varied by feeding the carrier liquid via a bypass line bypassing the mixer into the discharge conduit to thin the prepared plugging fluid (see the same book "Apparatus and Processes of Well Cementation" by S.V. Logvinenko, NEDRA Publishers, 1965). This method is performed, as follows:

- feeding the dry cementing mixture into the mixing chamber;
- pumping the carrier liquid into the mixing chamber;
- mixing the dry cementing mixture with the liquid in the mixing chamber;
- directing the prepared plugging fluid into the discharge conduit;
- thinning the plugging fluid with the carrier liquid to the required density in the discharge conduit.

However, the foregoing method is also not free from disadvantages:

- the density of the plugging fluid cannot be controlled to increase this density, the controlling technique providing solely for reducing this density;

- the prolonged time of coming up to the operation duty;
- considerable waste of the fluid.

Preparation of plugging fluids is effected in known apparatus of the hydraulic mixer type.

Thus, there is known a hydraulic mixer comprising a mixing chamber having secured thereto a discharge conduit and a tubular elbow bend having a uniformly flaring conical jet outlet and a replaceable nozzle with a cylindrical bore, which can be screwed into the elbow bend housing after having unscrewed and removed the plug (see "Cement Mixing Unit 1AS-20" by N.G. Kurbanov, in "Machines and Oil Equipment" Manual, vol. 6, Appendix 1, VNIIOENG, Moscow, 1966).

There is also known a hydraulic mixer comprising a discharge conduit secured to the mixing chamber, the opposite side of the mixing chamber supporting an elbow bend. The elbow bend has mounted therein a rotatable magazine having a flange through which a plurality of bores of different diameters are made. By aligning the bores of the selected diameters with the jet nozzle, it is possible to vary the capacity of the apparatus and also the density of the fluid step-wise without interrupting the plugging process.

To rotate the magazine, first, a handle is operated to release a ball-type retaining device and then the handle is rotated to align the selected bore of the magazine with the nozzle, whereafter the handle is operated once again to retain the magazine (see "Apparatus and Processes of Well Cementation" by S.V. Logvinenko, NEDRA Publishers, Moscow, 1965 — Appendix No. 2, p. 10).

Outside the USSR there is relatively widely utilized the hydraulic mixer marketed by the "Haliburton" company.

This mixer includes a conical hopper for funnel secured to a mixing chamber to which there is also secured the discharge conduit. On the opposite side of the mixing chamber there is situated a device for varying the cross-sectional area of the jet nozzle, including a ground-in plug with three bores of different cross-sectional areas and one great bore which acts as the inlet of the carrier liquid and communicates with the pressure line. The bores can be changed over in the course of the plugging operation by rotating the plug (see "Composite Catalog of Oil Field Equipment and Services", USA, V-II, 1966–1967).

A disadvantage of the foregoing known mixers is the impossibility of controlling the density of the plugging fluid at a permanent preset flow rate of the carrier liquid.

Another disadvantage of the known mixers is the prolonged time of coming up to the required density of the plugging fluid, which involves considerable waste of the fluid.

It is an object of the present invention to create a method of controlling the density of a plugging fluid, which should provide for obtaining a predetermined density, while maintaining a permanent flow rate of the cementing liquid.

It is another object of the present invention to create a method of infinite control of the density of a plugging fluid, with reduction of the time of attaining the required value of the density and with the density being stably maintained at the preset level.

It is still another object of the present invention to create the abovespecified method, which should prevent the waste of a plugging fluid which does not conform to the required standards and preclude the cases of cementing wells with inadequate quality.

It is yet another object of the present invention to create a plugging fluid preparation method, which method is characterized by increased productivity, relative simplicity and sufficient reliability.

To attain these and other objects, in accordance with the present invention there is proposed a method of controlling the density of a plugging fluid, prepared by mixing continuously supplied flows of a dry cementing material and of a carrier liquid, whereafter the prepared plugging fluid is discharged, the method being characterized in that it includes shaping the said flow of the carrier liquid into a flat jet directed into the mixing zone and rotating the flat jet about the longitudinal axis thereof to adjust the material-engaging area of the jet, through an angle corresponding to the required density of the plugging fluid to be prepared.

The novel features of the present invention enables one to control the density of the plugging fluid being prepared, and that at a permanent feed rate of the carrier liquid, the method substantially reduces the time required for coming up to the predetermined density.

In accordance with an embodiment of the present invention, the disclosed method is characterized in that with a gravity vertical feed of the dry cementing material the said flat jet is directed horizontally, transversely of the stream of the dry material, the jet being rotatable about the central axis of symmetry thereof.

This feature, in its turn, provides for controlling the density of the plugging fluid with any constant level of the column of the dry cementing material in the feed hopper of the mixing apparatus.

Other objects and advantages of the present invention will become apparent from the following detailed description of the embodiments of the disclosed apparatus and of the essence of the disclosed method, with reference being had to the accompanying drawings, wherein.

The technique of controlling the density of a plugging fluid by the herein disclosed method includes the following operations, performed in a sequence to be described hereinbelow.

Figure 1:
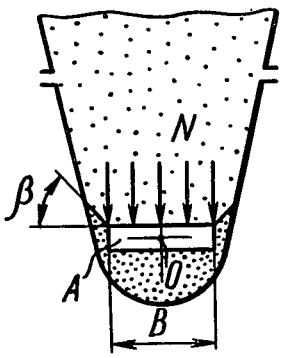
FIG. 1 illustrates schematically the setting of the apparatus, with the area of taking-up the dry cementing material being shown at the maximum, whereby the density of the plugging fluid is likewise maximal.
Figure 2:
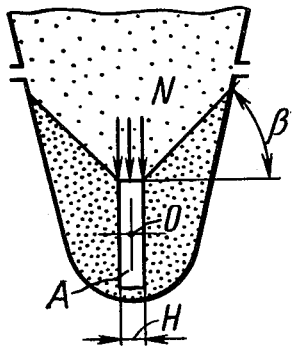
FIG. 2 illustrates the position of the jet with the area of taking-up the cementing material being shown as minimum, and the density of the plugging fluid is minimal.
Figure 3:
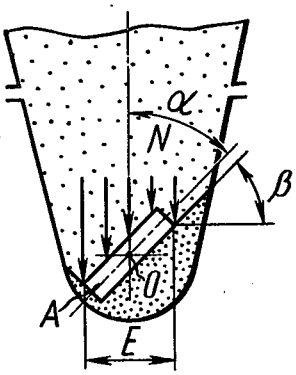
FIG. 3 illustrates the position of the jet in the apparatus corresponding to an intermediate area of taking-up the cementing material, whereby an intermediate value of the density is attained.

A dry cementing mixture "N" (FIGS. 1 to 3) is fed from a bin into a feed hopper, wherefrom it is supplied into the mixing chamber. A carrier liquid "A" is charged through a nozzle member also into the mixing chamber, this carrier liquid "A" being pre-shaped into a flat jet by aid of a rectangular slot-shaped outlet in the nozzle member. With the pressure P being from 10 to 20 kgf/cm$^2$ the jet of the liquid substantially retains its shape without dispersing within the confines of the mixing chamber of the hydraulic mixer. To control the density of the plugging fluid, the flat jet is rotated about its symmetry axis relative to the stream of the dry cementing material.

With the flat jet being thus rotated, the surface area of its projection upon the plane perpendicular to the stream of the dry cementing material is varied, which means that the area over which the jet engages and takes up the material is varied, as well as the quantity of the material "N" taken up by the jet.

Thus, with the flat jet being horizontal (FIG. 1) and the greater side "B" of the jet being perpendicular to the stream of the dry material "N", the quantity of the material taken by the jet is at the maximum, whereby the density of the plugging fluid is maximal.

The body of the cementing material within the space of the mixing chamber, underlying the jet, and the portions of the material defined by the angle $\beta$ of natural repose remain immobile.

With the jet being positioned vertically (FIG. 2) and the smaller side "H" of the jet being perpendicular to the stream of the cementing material "N", the quantity of the dry mixture being taken up by the jet is at the minimum, and the density of the plugging fluid obtained is likewise minimal. In the intermediate positions (FIG. 3) the area of taking up the dry mixture is defined by the horizontal projection "E" of the jet.

Thus, by varying the surface area of the projection of the jet of the carrier liquid "A" onto the plane perpendicular to the stream of the dry cementing material "N" by means of rotation of the jet about its symmetry axis, without any replacement of the nozzle and with the flow rate of the liquid being permanent, the quantity of the dry mixture taken up by the jet and, consequently, the value of the density of the plugging fluid are varied between the minimum and the maximum.

Figure 4:
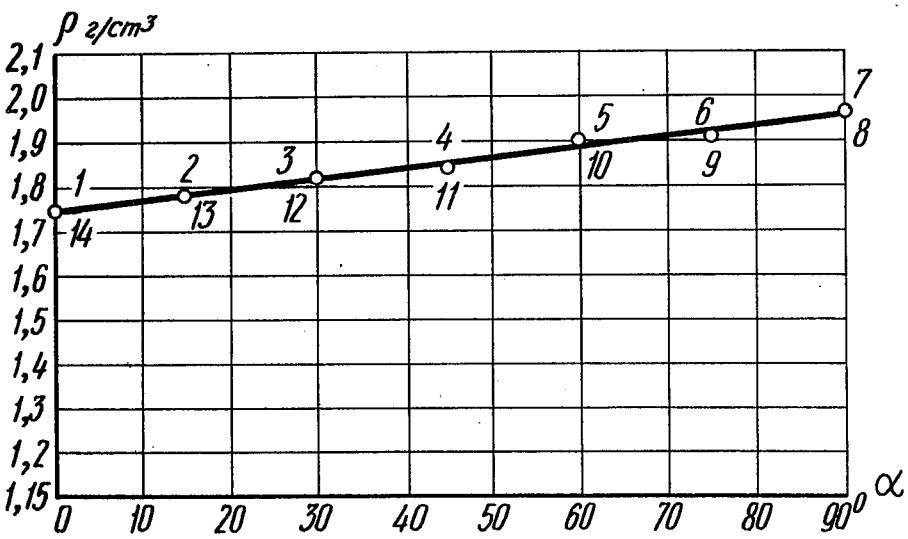
FIG. 4 illustrates graphically the variation of the density of the plugging fluid, depending on the angle of rotation of the plane of the flat jet of the carrier liquid.

The variation of the density of the plugging fluid, depending on the angle of rotation of the plane of the carrier liquid jet "A" relative to the stream of the dry material "N" is graphically illustrated in FIG. 4.

The curve in the drawing is based on the data obtained at preparation of plugging fluids with portland cement. From the diagram in FIG. 4 it can be seen that the density of the plugging fluid varies linearly with the flat jet being rotated relative to the stream of the dry material between 0° and 90° (i.e. the curve is practically a straight line), between 1.74 g/cm$^3$ to 1.96 g/cm$^3$ (refer to points 1, 2, 3, 4, 5, 6, 7), the fluctuations of the density of the plugging fluid at any angular position of the nozzle member being within $\mp$ 0.02 g/cm$^3$.

Portland cement is utilized for preparation of plugging fluids in a density range from 1.78 to 1.83 g/cm$^3$.

In the above example the controllable density range is from 1.74 to 1.96 g/cm$^3$, i.e. the range of the densities of the plugging fluid to be prepared with portland cement is positively overlapped at both ends.

Thus, at cementation of a well the density of the plugging fluid was to be maintained, according to the outcome of a laboratory analysis, within a range from 1.78 to 1.83 g/cm$^3$. There was mounted in the hydraulic mixer a slot-shaped nozzle member with the flow passage area equivalent to a round outlet with a 12 mm diameter, the slot being positioned vertically.

The carrier liquid was charged at 15 kgf/cm$^2$, the cementing material was fed to the mixer, and the density of the plugging fluid was 1.73 g/cm$^3$.

Following the rotation of the nozzle member through 30° from the vertical position, with the same pressure of the carrier liquid, the density of the plugging fluid became 1.80 g/cm$^3$.

The time required for coming up to the required density of the fluid was 23 seconds.

At this operating duty 20 tons of portland cement were consumed. Throughout the entire plugging operation 40 check-up measurements of the density of the fluid were made. Every measurement shown the density of the fluid equalling 1.80 g/cm$^3$.

Figure 5:
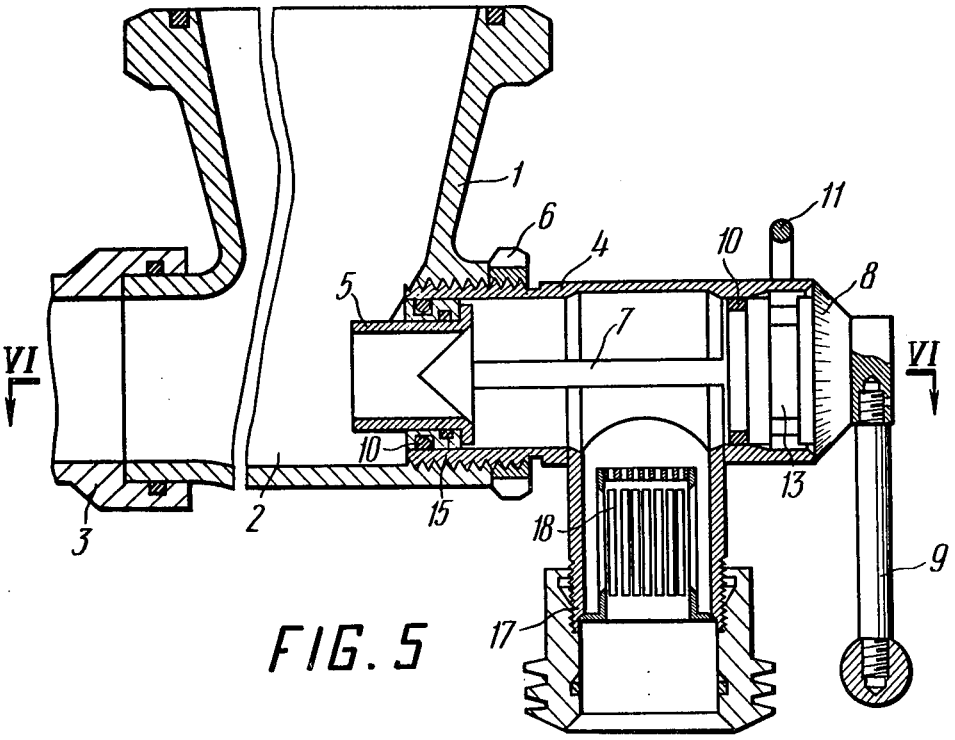
FIG. 5 is a cross sectional view of the apparatus.
Figure 6:
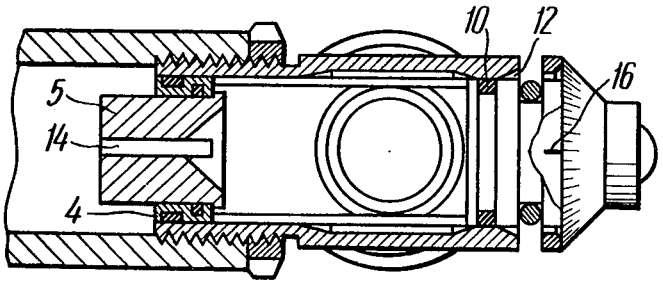
FIG. 6 is a cross sectional view taken along the line VI—VI in FIG. 5.

In order to better understand the method of the invention, reference is now made to an apparatus for carrying out said method which includes a feed hopper or funnel 1 (FIG. 5) attached to a mixing chamber 2. The mixing chamber 2 has also secured thereto a discharge conduit 3. In opposition to the discharge conduit 3 and axially aligned therewith there is mounted a liquid charging unit including an elbow bend 4 and a nozzle member 5. The elbow bend 4 is threaded into the housing of the mixing chamber 2 and secured with a lock nut 6. The internal counterbore of the elbow bend 4 receives therein a rotatable sleeve 7 (FIG. 6) with a dial 8 calibrated to read the angles of rotation of the sleeve, as well as the values of the density of the plugging fluid. A handle 9 is attached to the sleeve 7 to effect its angular adjustment.

Figure 7:
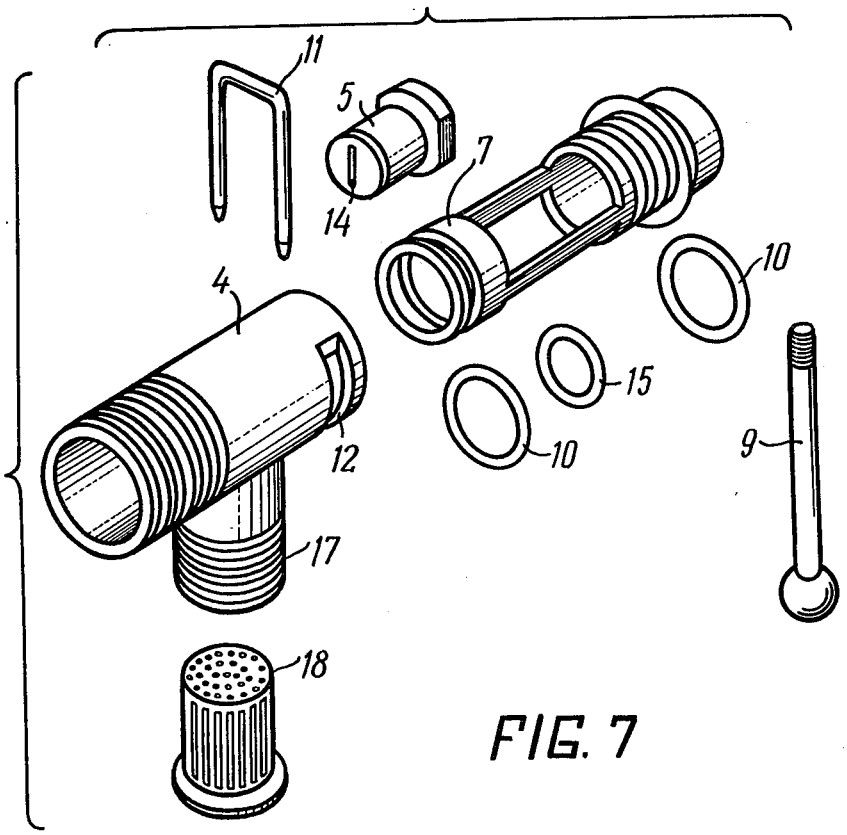
FIG. 7 is an exploded view of the carrier liquid charging unit with the nozzle member.

The cylindrical surfaces of the sleeve 7 are sealed in the counterbore of the elbow bend 4 with rubber seal rings 10. The position of the sleeve 7 in the elbow bend 4 is fixed with a resilient insertable clip 11 (FIG. 7) receivable in the slots 12 of the elbow bend 4 and in an annular groove 13 of the sleeve 7, the clip 11 permitting rotation of the sleeve. The nozzle member 5 with an outlet shaped as a slot 14 is inserted through a port in the wall of the sleeve 7 and then made to abut by its flange against the corresponding shoulder of the sleeve. The cylindrical surface of the nozzle member 5 is sealed with a rubber sseal ring 15 accommodated in an internal annular groove of the sleeve 7. The sleeve 7 in the assembled state is rotatable jointly with the nozzle member 5 through required angles by means of the handle 9, the angular adjustment being read against a pointer mark 16 on the elbow bend 4.

The connection piece 17 of the elbow bend 4 is equipped with a filter 18 through which the carrier liquid is forced into the internal space of the sleeve 7 to issue from the slot-shaped outlet 14 of the nozzle member 5.

The herein disclosed apparatus operates, as follows.

The carrier liquid is forced at a predetermined pressure through the connection 17 and the slot 14 of the nozzle member 5, wherefrom it issues in a substantially flat jet. At the initial stage of the process the nozzle 5 with the slot 14 and the jet are positioned horizontally. With the required pressure attained, a dry cementing material is fed via the hopper 1 into the housing of the mixing chamber 2. The dry material is taken up by the jet to mix with the carrier liquid in the mixing chamber and to be discharged via the discharge conduit 3.

Depending on the deviation of the density of the fluid from the required value, the sleeve 7 is rotated jointly with the nozzle member 5, and, consequently, with the liquid jet issuing therefrom through a corresponding angle of which the value can be found for any cementing mixture in a Table appended to the hydraulic mixer.

In the present disclosure the invention has been described in connection with preparation of plugging or cementing fluids, since in the course of preparation of such fluids it is of paramount importance to maintain the required value of the density. However, those component in the art can clearly comprehend that the herein disclosed method and apparatus can be successfully utilized at preparation of flushing, construction and other liquids and mortars, as well as in other techniques where it is essential to infinitely control the ratio of liquid and solid components.

What we claim is:

1. A method of controlling the density of a fluid, such as a plugging fluid comprising a mixture of dry solid material and a liquid, comprising the steps of supplying continuously a stream of said dry solid material and a flow of a carrier liquid, pre-shaping the flow of said carrier liquid into a substantially flat jet, mixing said flow of the carrier liquid with said dry solid material in a mixing zone, and rotating said substantially flat jet of said carrier liquid about the longitudinal axis thereof in the mixing zone through an angle corresponding to a required density of the fluid being prepared.

2. A method as claimed in claim 1, wherein with a vertical gravity feed of the dry solid material, said substantially flat jet is directed horizontally transversely of the flow of the dry solid material and rotated about the central axis of symmetry of said flat jet.

3. The method according to claim 1, wherein a maximum density of the fluid is achieved with said substantially flat jet being disposed horizontally with the wide or flat side portion of the jet being perpendicular to the stream of dry solid material.

4. The method according to claim 1, wherein a minimum density of the fluid is achieved with said substantially flat jet being disposed vertically with the narrow or thin end portion of the jet being parallel to the stream of dry solid material.

5. The method according to claim 1, wherein the density of said fluid varies substantially linearly between a maximum when said flat jet is disposed horizontally relative to said stream of dry solid material and a minimum when said flat jet is disposed vertically relative to said stream of dry solid material.

6. The method according to claim 5, wherein the density of the fluid is varied from a maximum to a minimum when said substantially flat jet is rotated at an angle between 0° and and 90°.

* * * * *